US007468699B2

(12) United States Patent
Manholm et al.

(10) Patent No.: US 7,468,699 B2
(45) Date of Patent: Dec. 23, 2008

(54) TRIPLE POLARIZED PATCH ANTENNA

(75) Inventors: Lars Manholm, Gothenburg (SE); Fredrik Harrysson, Gothenburg (SE)

(73) Assignee: Telefonaktiebolaget L M Ericsson (Publ), Stockholm (SE)

( * ) Notice: Subject to any disclaimer, the term of this patent is extended or adjusted under 35 U.S.C. 154(b) by 12 days.

(21) Appl. No.: 11/722,910

(22) PCT Filed: Dec. 27, 2004

(86) PCT No.: PCT/SE2004/002010

§ 371 (c)(1), (2), (4) Date: Jun. 27, 2007

(87) PCT Pub. No.: WO2006/071139

PCT Pub. Date: Jul. 6, 2006

(65) Prior Publication Data

US 2008/0136734 A1 Jun. 12, 2008

(51) Int. Cl.
*H01Q 1/38* (2006.01)
*H01Q 9/38* (2006.01)

(52) U.S. Cl. ..... 343/700 MS; 343/830

(58) Field of Classification Search ..... 343/700 MS, 343/830, 853, 893
See application file for complete search history.

(56) References Cited

U.S. PATENT DOCUMENTS 4,835,538 A * 5/1989 McKenna et al. ..... 343/700 MS
5,155,493 A * 10/1992 Thursby et al. ..... 343/700 MS
5,874,919 A * 2/1999 Rawnick et al. ..... 343/700 MS
6,118,406 A * 9/2000 Josypenko ..... 343/700 MS

* cited by examiner

*Primary Examiner*—Shih-Chao Chen

(57) ABSTRACT

An antenna arrangement for a Multiple Input Multiple Output (MIMO) radio system, the antenna arrangement transmitting and receiving in three essentially uncorrelated polarizations. The arrangement includes three parallel, stacked patches separated by first and second slots. A first feeding line feeds the first patch, and at least a second and third feeding line feed the second patch. In a first operating mode, the first feeding line generates a first constant E-field in the first slot between the edges of the first and second patches. In a second operating mode, the second feeding line contributes to a second, sinusoidally varying E-field in the second slot between the edges of the second and third patches. In a third operating mode, the third feeding line contributes to a third, sinusoidally varying E-field in the second slot between the edges of the second and third patches.

10 Claims, 3 Drawing Sheets

TRIPLE POLARIZED PATCH ANTENNA

TECHNICAL FIELD

The present invention relates to an antenna arrangement comprising a first, a second and a third patch, each patch being made in a conducting material and having a first and a second main surface, which patches are placed one above the other with the first patch at the top, such that all of said main surfaces are essentially parallel to each other, in which antenna arrangement the first patch has a first edge, the second patch has a second edge and the third patch has a third edge, where furthermore the antenna arrangement comprises a feeding arrangement.

BACKGROUND ART

The demand for wireless communication systems has grown steadily, and is still growing, and a number of technological advancement steps have been taken during this growth. In order to acquire increased system capacity for wireless systems by employing uncorrelated propagation paths, MIMO (Multiple Input Multiple Output) systems have been considered to constitute a preferred technology for improving the capacity. MIMO employs a number of separate independent signal paths, for example by means of several transmitting and receiving antennas. The desired result is to have a number of uncorrelated antenna ports for receiving as well as transmitting.

For MIMO it is desired to estimate the channel and continuously update this estimation. This updating may be performed by means of continuously transmitting so-called pilot signals in a previously known manner. The estimation of the channel results in a channel matrix. If a number of transmitting antennas Tx transmit signals, constituting a transmitted signal vector, towards a number of receiving antennas Rx, all Tx signals are summated in each one of the Rx antennas, and by means of linear combination, a received signal vector is formed. By multiplying the received signal vector with the inverted channel matrix, the channel is compensated for and the original information is acquired, i.e. if the exact channel matrix is known, it is possible to acquire the exact transmitted signal vector. The channel matrix thus acts as a coupling between the antenna ports of the Tx and Rx antennas, respectively. These matrixes are of the size M×N, where M is the number of inputs (antenna ports) of the Tx antenna and N is the number of outputs (antenna ports) of the Rx antenna. This is previously known for the skilled person in the MIMO system field.

In order for a MIMO system to function efficiently, uncorrelated, or at least essentially uncorrelated, transmitted signals are required. The meaning of the term "uncorrelated signals" in this context is that the radiation patterns are essentially orthogonal. This is made possible for one antenna if that antenna is made for receiving and transmitting in at least two orthogonal polarizations. If more than two orthogonal polarizations are to be utilized for one antenna, it is necessary that it is used in a so-called rich scattering environment having a plurality of independent propagation paths, since it otherwise is not possible to have benefit from more than two orthogonal polarizations. A rich scattering environment is considered to occur when many electromagnetic waves coincide at a single point in space. Therefore, in a rich scattering environment, more than two orthogonal polarizations can be utilized since the plurality of independent propagation paths enables all the degrees of freedom of the antenna to be utilized.

Antennas for MIMO systems may utilize spatial separation, i.e. physical separation, in order to achieve low correlation between the received signals at the antenna ports. This, however, results in big arrays that are unsuitable for e.g. hand-held terminals. One other way to achieve uncorrelated signals is by means of polarization separation, i.e. generally sending and receiving signals with orthogonal polarizations.

It has then been suggested to use three orthogonal dipoles for a MIMO antenna with three ports, but such an antenna is complicated to manufacture and requires a lot of space when used at higher frequencies, such as those used for the MIMO system (about 2 GHz). Up to six ports have been conceived, as disclosed in the published application US 2002/0190908, but the crossed dipole and the accompanying loop element is still a complicated structure that is difficult to accomplish for higher frequencies to a reasonable cost.

The objective problem that is solved by the present invention is to provide an antenna arrangement suitable for a MIMO system, which antenna arrangement is capable of sending and receiving in three essentially uncorrelated polarizations. The antenna arrangement should further be made in a thin structure to a low cost, and still be suitable for higher frequencies, such as those used in the MIMO system.

DISCLOSURE OF THE INVENTION

This objective problem is solved by means of an antenna arrangement according to the introduction, which antenna arrangement further is characterized in that the feeding arrangement comprises a first feeding point arranged in the first patch, positioned at a first imagined line passing the patches essentially perpendicular to the respective first and second main surfaces, where the feeding arrangement further comprises at least a second and a third feeding point arranged in the second patch, each of said second and a third feeding points being positioned at a respective distance from the first imagined line, where a second and third imagined line passes perpendicular to, and intersects, the first line and where the second imagined line also intersects the second feeding point and the third imagined line also intersects the third feeding point, the second and third imagined line presenting an angle $\alpha$ between each other, the angle $\alpha$ being essentially 90°, where the first feeding point is arranged for feeding the first patch transmission as well as in reception and the second and third feeding points are arranged for feeding the first and second patches, respectively, in transmission as well as in reception, and where, in a first mode of operation, the first feeding point enables a first constant E-field being obtained in a first slot created between the first and second edges, which first E-field further is directed between said edges, and, in a second mode of operation, the second feeding point contributes to obtaining a second E-field in a second slot created between the second and third edges, which second E-field further is directed between the second and third edges and has a sinusoidal variation along the second slot, and, in a third mode of operation, the third feeding point contributes to obtaining a third E-field in the second slot, which second E-field further is directed between the second and third edges and has a sinusoidal variation along the second slot.

Preferred embodiments are disclosed in the dependent claims.

Several advantages are achieved by means of the present invention, for example:

- A low-cost triple polarized antenna arrangement is obtained.

A triple polarized antenna made in planar technique is made possible, avoiding space consuming antenna arrangements.

A triple polarized antenna which is easy to manufacture is obtained.

BRIEF DESCRIPTION OF THE DRAWINGS

The present invention will now be described in more detail with reference to the appended drawings, where.

PREFERRED EMBODIMENTS

According to the present invention, a so-called triple-mode antenna arrangement is provided. The triple-mode antenna arrangement is designed for transmitting three essentially orthogonal radiation patterns.

Figure 1A:
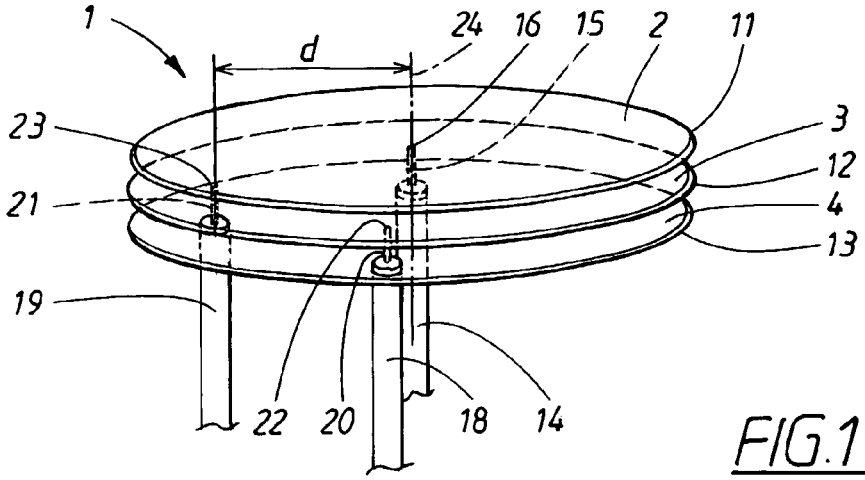
FIG. 1*a* shows a schematic simplified perspective view of a first embodiment of the antenna arrangement according to the invention.
Figure 1B:
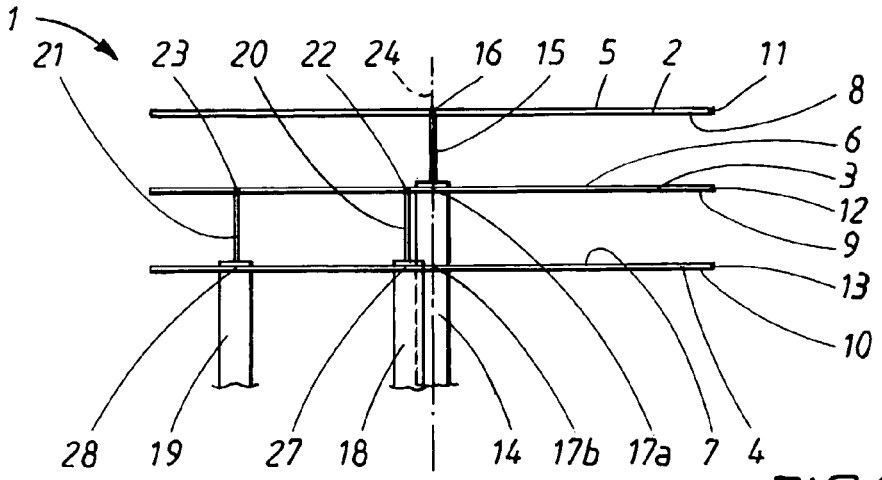
FIG. 1*b* shows a schematic side view of a first embodiment of the antenna arrangement according to the invention.
Figure 1C:
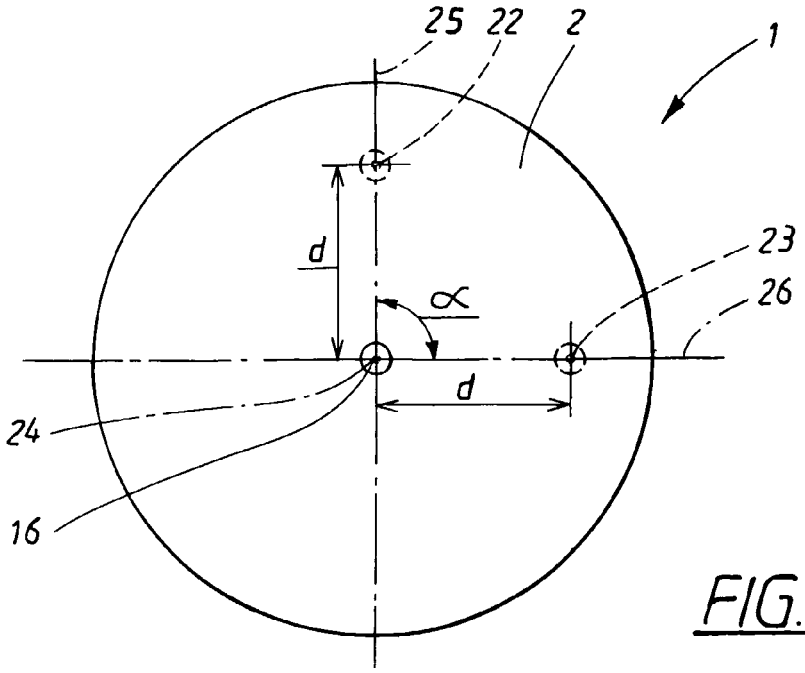
FIG. 1*c* shows a schematic top view of a first embodiment of the antenna arrangement according to the invention.

As shown in FIG. 1*a-c*, illustrating a first embodiment of the present invention, a triple-mode antenna arrangement 1 comprises a first 2, second 3 and third 4 patch. Each patch 2, 3, 4 is relatively thin, having a first 5, 6, 7 and a second 8, 9, 10 main surface, which first 5, 6, 7 and second 8, 9, 10 main surfaces are essentially parallel to each other, and the patches 2, 3, 4 are made in a conducting material, such as copper. The patches 2, 3, 4 are preferably round in shape and placed one above the other with the first patch 2 at the top. The patches 2, 3, 4 also have a corresponding first, second and third edge 11, 12, 13.

The triple-mode mode antenna arrangement 1 also comprises a centrally located first coaxial feed line 14, having a first centre conductor 15 that makes electrical contact with the first patch 2 in its central area, constituting a first feeding point 16. The first centre conductor 15 makes no electrical contact with any of the other patches 3, 4. The first coaxial feed line 14 further passes through the central area of the second 3 and third 4 patch by means of holes 17*a, b* made into these, through which the first coaxial feed 14 line may run.

The triple-mode mode antenna arrangement 1 further comprises a second 18, and third 19 coaxial feed line, having a second 20 and third 21 centre conductor, respectively, which second 20 and third 21 centre conductor each makes electrical contact with the second patch 3 in its outer area, thereby constituting a second 22 and third 23 feeding point. Also, with reference to FIG. 1*c*, the second 22 and third 23 feeding points are positioned at an appropriate distance d from a first imagined line 24 passing through the first feeding point 16 essentially perpendicular to the main planes 5, 6, 7; 8, 9, 10. The distance d is preferably essentially the same for the second 20 and third 21 centre conductors (only shown for the third feeding point in FIG. 1*a*).

A second 25 and third 26 imagined line passes perpendicular to the first imagined line 24 and each intersect the second 22 and third 23 feeding points, presenting an angle $\alpha$ between each other. The angle $\alpha$ is essentially 90°. The lines 24, 25, 26 are inserted for explanatory reasons only, and are not part of the real device 1.

The feeding coaxial lines 14, 18, 19 with their centre conductors 15, 20, 21 constitute a feeding arrangement.

The second 20 and third 21 centre conductors make no electrical contact with any of the other patches 2, 4, and mainly extend perpendicular to the main surfaces 5, 6, 7; 8, 9, 10 of the patches 2, 3, 4. These coaxial feed lines 20, 21 further passes through the outer area of the third patch 4 by means of holes 27, 28 made into this, through which these coaxial feed 20, 21 lines may run.

The electrical contact between the first 2 and second 3 patch and their belonging centre conductors 15; 20, 21 at the corresponding feeding points 16; 22, 23 is for example obtained by means of soldering.

By means of the first 14, second 18 and third 19 coaxial feed lines, the patches 2, 3, 4 are excited in three different ways, in a first, second and third mode of operation, enabling three orthogonal radiation patterns to be transmitted.

At the first mode of operation, the first patch 2 is fed by a signal from the first coaxial feed line 14. The second patch 3 then acts as a ground plane for the first patch 2. In this a way a degenerated hat-monopole is obtained.

Figure 2A:
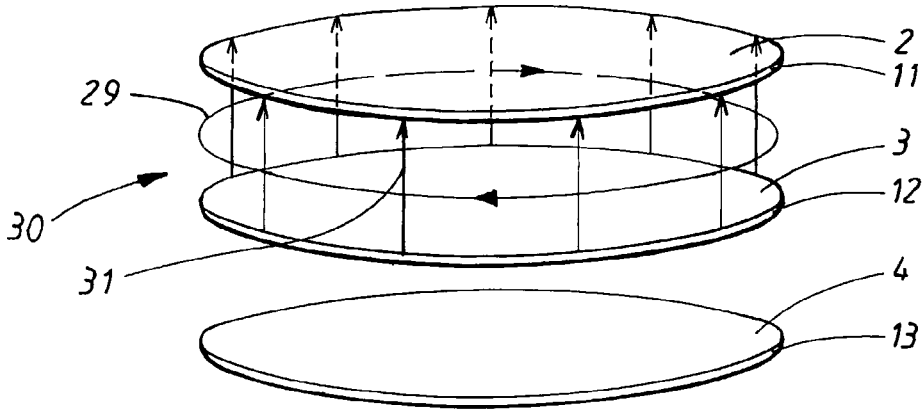
FIG. 2*a* shows a schematic simplified side view of the field distribution at the patches of the antenna arrangement according to the invention at a first mode of operation.

Also with reference to FIG. 2*a*, which for reasons of clarity shows the patches without the feeding arrangement, this results in a constant magnetic current loop 29 running in a circumferential slot 30 created between the edges 11, 12 of the first and second 3 patch, respectively. This magnetic current 29 corresponds to a first E-field 31, all around the circumference of the first 2 and second 3 patch, which first E-field 31 is constant and directed essentially perpendicular to the main surfaces 5, 6; 8, 9 of the first 2 and second 3 patch in the slot 30. In FIG. 2*a*, this is shown with a number of arrows.

With reference to FIG. 1*a-c*, at the second mode of operation, one signal is fed to the second patch 3 via the second feeding point 20, from the second coaxial feed line 18. The third patch 4 then acts as a ground plane for the second patch 3.

Figure 2B:
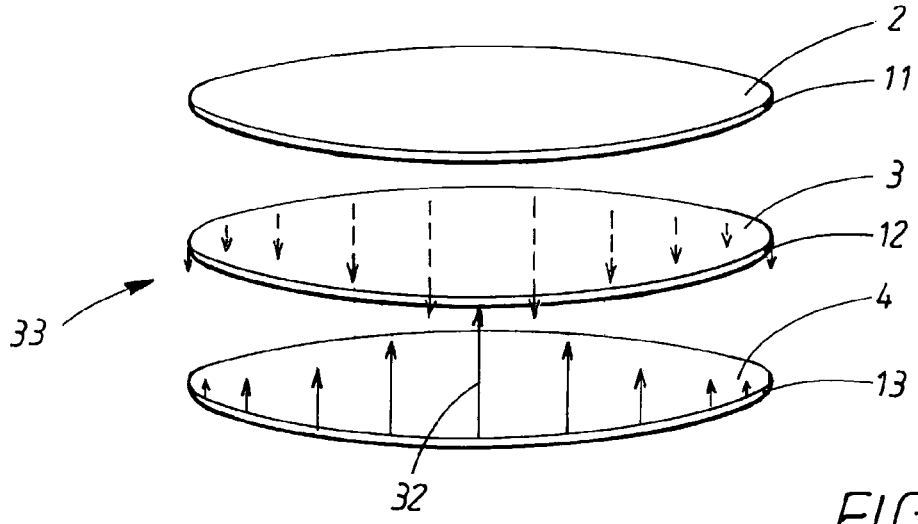
FIG. 2*b* shows a schematic simplified side view of the field distribution at the patches of the antenna arrangement according to the invention at a second mode of operation.

With reference also to FIG. 2*b*, which for reasons of clarity shows the patches without the feeding arrangement, this in turn results in a second E-field 32 directed essentially perpendicular to the main surfaces 6, 7; 9, 10 of the second 3 and third 4 patches in a circumferential slot 33 created between the edges 12, 13 of the second 3 and third 4 patch, respectively, having a sinusoidal variation all around the circumference of the second 3 and third 4 patch. The E-field 32 is shown in FIG. 2*b* as a number of arrows having a length that corresponds to the strength of the E-field, where the arrows indicate an instantaneous E-field distribution as it varies harmonically over time.

With reference to FIG. 1*a-c*, the third mode of operation corresponds to the second mode of operation, but here one signal is fed to the second patch 3 via the third coaxial feed line 19, the signal in question being in phase with the signal that is fed to the second feeding point 22. However, as mentioned above, the corresponding third feeding point 23 is displaced 90° with respect to the second feeding point 22 with reference from the first feeding point 16. The third patch 4 also here acts as a ground plane for the second patch 3.

Figure 2C:
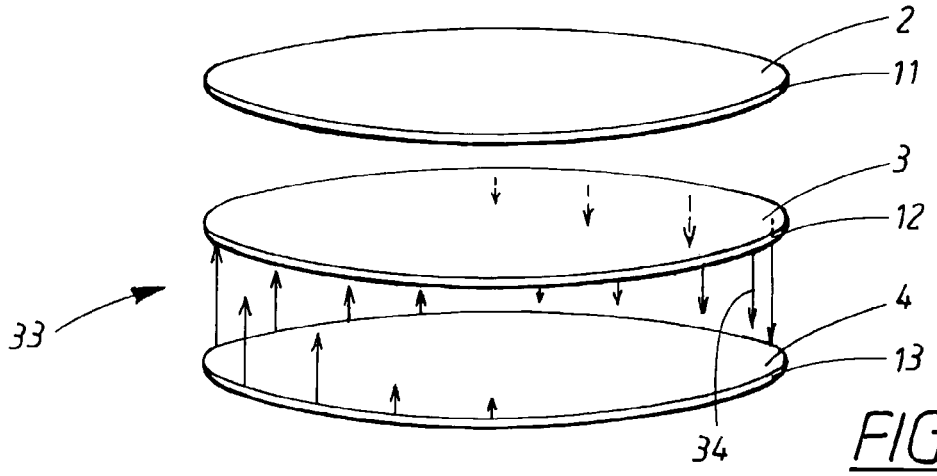
FIG. 2*c* shows a schematic simplified side view of the field distribution at the patches of the antenna arrangement according to the invention at a third mode of operation.

Also with reference to FIG. 2*c*, which for reasons of clarity shows the patches without the feeding arrangement, this in turn results in a third E-field 34 directed essentially perpendicular to the main surfaces 6, 7; 9, 10 of the second 3 and third 4 patches in the circumferential slot 33 created between the edges 12, 13 of the second 3 and third 4 patch, respectively, having a sinusoidal variation all around the circumference of the second 3 and third 4 patch. Using the same reference direction for the fields, if the second E-field 32 varies with sine, the third E-field 34 varies with cosine. This means that the third E-field 34 further is perpendicular to the second E-field 32, this will be explained more in detail later.

In the same way as for the second mode of operation, the third E-field is shown in FIG. 2*c* as a number of arrows having a length that corresponds to the strength of the E-field, where the arrows indicate an instantaneous E-field distribution as it varies harmonically over time.

Thus, the triple-mode antenna arrangement 1 is now excited in three different ways, thus acquiring three different modes with a first 31, second 32 and third 34 E-field, constituting aperture fields which all ideally are orthogonal to each other.

The corresponding radiation patterns are also orthogonal, and the correlation equals zero, where the correlation ρ may be written as $$\rho = \frac{\oint_{\Omega} \vec{E}_1(\Omega)\vec{E}_2^*(\Omega)d\Omega}{\sqrt{\oint_{\Omega}\left|\vec{E}_1(\Omega)\right|^2 d\Omega \oint_{\Omega}\left|\vec{E}_2(\Omega)\right|^2 d\Omega}}$$

In the equation above, Ω represents a surface and the symbol * means that it is a complex conjugate. For the integration of the radiation pattern, Ω represents a closed surface comprising all space angels, and when this integration equals zero, there is no correlation between the radiation patterns, i.e. the radiation patterns are orthogonal to each other. The denominator is an effect normalization term.

When determining that the radiation patterns are orthogonal, it is possible to use the aperture fields. When considering the aperture fields, Ω represents an aperture surface. The aperture fields between the edges 11, 12, 13 are orthogonal since the integration of a constant (the first mode) times a sinusoidal variation (second or third mode) over one period equals zero. Further, the integration of two orthogonal sinusoidal variations, sine*cosine, (the second and third mode) over one period also equals zero. As these fields 31, 32, 34 are orthogonal at the aperture of the antenna arrangement 1 and correspond to aperture currents (not shown) of the antenna 1, which aperture currents then also are orthogonal, the far-field also comprises orthogonal field vectors, as known to those skilled in the art.

Having three, at least essentially, orthogonal radiation patterns is desirable, since this enables the rows in the channel matrix to be independent. This in turn means that the present invention is applicable for the MIMO system.

By means of superposition, all modes of operation may be operating at the same time, thus allowing the triple-mode antenna arrangement to transmit three essentially orthogonal radiation patterns.

The actual implementation of the feeding arrangement is not important, but may vary in ways which are obvious for the skilled person. The important feature of the present invention is that the patches 2, 3, 4 are fed in three modes of operation, where the first mode of operation results in an E-field 31 being acquired at the circumferential slot 30 between the first 2 and second 3 patch. The other modes of operation result in two E-fields 32, 34 which have sine variations of the field strength being acquired at the circumferential slot 33 between the second 3 and third 4 patch, where one of these E-fields is rotated 90° with respect to the other. This function is not limited by the design of the feeding arrangement or how the feeding points 16, 22, 23 are conceived. They may for example obtain electrical connection in a contactless manner, i.e. by means of capacitive coupling as known in the art.

Figure 3A:
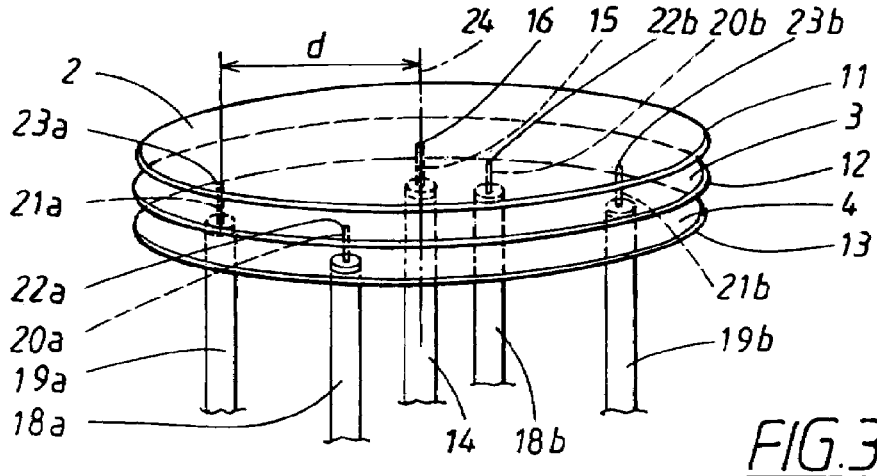
FIG. 3*a* shows a schematic simplified perspective view of a second embodiment of the antenna arrangement according to the invention.
Figure 3B:
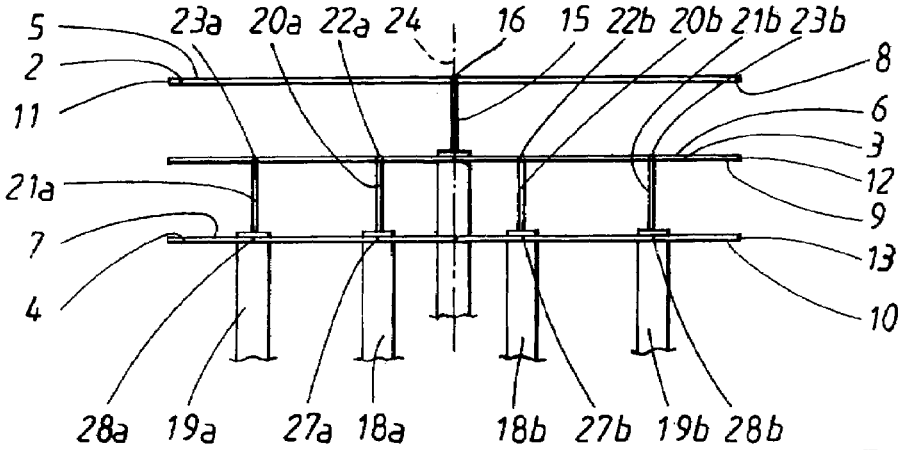
FIG. 3*b* shows a schematic side view of a second embodiment of the antenna arrangement according to the invention.

In an alternative second embodiment with reference to FIG. 3*a*-*b*, the patch arrangement of a triple-mode mode antenna arrangement 1' is the same as for the first embodiment, having the same reference numerals in the drawings. The difference between the embodiments is found in the feeding arrangement, where the triple-mode mode antenna arrangement 1' comprises a first 14, second 18*a*, third 19*a*, fourth 18*b* and fifth 19*b* coaxial feed line, having a first 15, second 20*a*, third 21*a*, fourth 20*b* and fifth 21*b* centre conductor, respectively.

The positioning of the first coaxial feed line 14 having a first centre conductor 15 and a first feeding point 16 corresponds with the one described above in connection with the first embodiment, and will not be further discussed here.

Figure 3C:
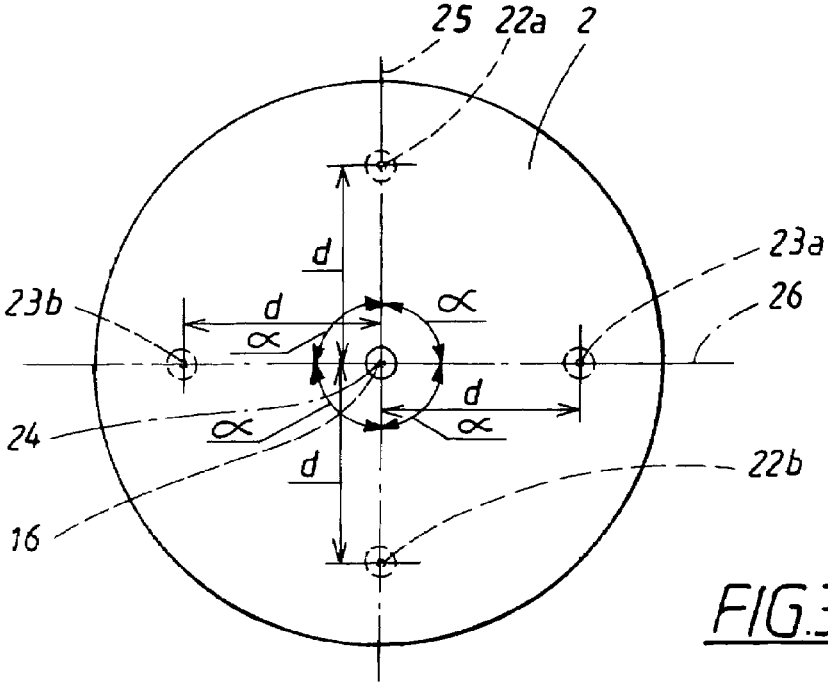
FIG. 3*c* shows a schematic top view of a second embodiment of the antenna arrangement according to the invention.

The second 20*a*, third 21*a*, fourth 20*b* and fifth 21*b* centre conductor each makes electrical contact with the second patch 3 in its outer area, having a second 20*a*, third 21*a*, fourth 20*b* and fifth 21*b* centre conductor, respectively, that each makes electrical contact with the second patch 3 in its outer area, there constituting a second 22*a*, third 23*a*, fourth 22*b* and fifth 23*b* feeding point. Also with reference to FIG. 3*c*, the second 22*a* third 23*a*, fourth 22*b* and fifth 23*b* feeding points are positioned at an appropriate distance d from a first imagined line 24 passing through the first feeding point 16 essentially perpendicular to the main planes 5, 6, 7; 8, 9,10. The distance d essentially is the same for the second 20*a*, third 21*a*, fourth 20*b* and fifth 21*b* centre conductors.

A second 25 and third 26 imagined line passes perpendicular to the first imagined line 24. The second imagined line 25 intersects the second 22*a* and fourth 22*b* feeding point having the first imagined line 24 positioned between them. The third 26 imagined line intersects the third 23*a* and fifth 23*b* feeding points, having the first imagined line (24) positioned between them. Furthermore, the second 25 and third 26 imagined lines present an angle α between each other. This is a way to define the angle between feeding points, the angle α is essentially 90°. The defining of an angle between feeding points in the above manner is referred to as an angular displacement further in the text. The lines 24, 25, 26 are inserted for explanatory reasons only, and are not part of the real device 1'.

There is thus an angular displacement of essentially 90° between the second 22*a* third 23*a*, fourth 22*b* and fifth 23*b* feeding points all the way around the circumference of a circle with the radius d. The second 22*a* third 23*a*, fourth 22*b* and fifth 23*b* feeding points are then positioned in such a way that the second 22*a* and fourth 22*b* feeding points are opposite each other and the third 23*a* and fifth 23*b* feeding points are opposite each other, the clockwise order of the succeeding feeding points of the second patch 3 being the second 22*a*, the third 23*a*, the fourth 22*b*, and the fifth 23*b*.

The feeding coaxial lines 14, 18*a*, 19*a*, 18*b*, 19*b* with their centre conductors 15, 20*a*, 21*a*, 20*b*, 21*b* constitute a feeding arrangement.

The second 22*a* and fourth 22*b* feeding point constitute a first feeding point pair and the fourth 23*a* and fifth 23*b* feeding point constitute a second feeding point pair. The feeding points in a feeding point pair are positioned at opposite sides of the first imagined line 24, separating each feeding point in a pair with an angular displacement of essentially $2*\alpha=180°$. Furthermore, each pair of corresponding feeding points has an angular displacement of 180°. This results in that all the feeding points are evenly distributed around the patch, each one separated with an angular displacement of essentially 90°.

The second 20*a*, third 21*a*, fourth 20*b* and fifth 21*b* centre conductors makes no electrical contact with any of the other patches 2, 4, and mainly extend perpendicular to the main surfaces 5, 6, 7; 8, 9, 10 of the patches 2, 3, 4. These second 18*a*, third 19*a*, fourth 18*b* and fifth 19*b* coaxial feed lines passes through the outer area of the third patch 4 by means of holes 27*a*, 28*a*, 27*b*, 28*b* made into this, through which these coaxial feed lines 18*a*, 19*a*, 18*b*, 19*b* may run.

The electrical contact between the first 2 and second 3 patches and the belonging centre conductors 15; 20*a*, 21*a*, 20*b*, 21*b* at the corresponding feeding points 16; 22*a*, 23*a*, 22*b*, 23*b* is for example obtained by means of soldering.

The second 18*a* and fourth 18*b* coaxial feed lines are fed 180° out of phase with each other, such that the second 22*a* and fourth 22*b* opposite feeding points are fed with a phase difference of 180°. Further, the third 19*a* and fifth 19*b* coaxial feed lines are also fed 180° out of phase with each other, such that the third 23*a* and fifth 23*b* opposite feeding points are fed with a phase difference of 180°. This phase shift may be introduced by means of conventional phase shifters (not shown), commonly used in the art, or in any other convenient way.

The triple-mode mode antenna arrangement 1' according to the second embodiment has three modes of operation which corresponds to those described in connection with the first embodiment with reference to FIG. 2*a-c*, and the same radiation properties are obtained here. The difference between the first and second embodiment is that the second embodiment comprises four feeding points at the second patch 3 instead of two. These four feed points constitutes a more balanced feeding, which is more easily impedance matched, but at the same time comprises a more complicated structure.

Due to reciprocity, for the transmitting properties of all the triple-mode antenna arrangements 1, 1' described, there are corresponding equal receiving properties, as known to those skilled in the art, allowing the triple-mode antenna arrangement to both send and receive in three essentially uncorrelated modes of operation.

The invention is not limited to the embodiments described above, which only should be regarded as examples of the present invention, but may vary freely within the scope of the appended claims.

Other types of patches may be conceivable, instead of those described. For example, the patches may have other shapes, for example square, rectangular or octagonal as well as cross- or star-shaped. The three patches may also have different shapes between themselves, i.e. the first patch may be octagonal, the second patch square etc.

The patches may be made in any appropriate conducting material, for example copper, aluminium, silver or gold. The patches may further be made from thin metal sheets and separated by air only, held in place by means of appropriate retainers (not shown). Alternatively, the patches may be etched from copper-clad laminates.

Any kind of feeding of the patches is within the scope of the invention, where different kinds of probe feed are the most preferred. The capacitive probe feed mentioned above is such an alternative.

The distance d between the first imagined line and the respective feeding points does not have to be the same for every feeding point, but may vary if appropriate. The positioning of the feeding points is determined by which impedance that is desired. In other words, the distance d is generally varied in order to obtain a desired impedance matching.

The first imagined line does not have to pass through a central area of the patches, but may pass the patches wherever appropriate.

The feed network may further be implemented in many different ways, which ways are obvious for the person skilled in the art. The patches may be fed in such a way that other mutually orthogonal polarizations may be obtained, for example right-hand circular polarization and/or left-hand circular polarization.

The invention claimed is:

1. An antenna arrangement comprising:

first, second and third planar parallel antenna patches: and a feeding mechanism for electrically feeding the antenna patches, said feeding mechanism comprising:

a first feeding line connected to the first antenna patch, wherein when the first feeding line feeds the first antenna patch, a first constant E-field is generated in a first slot between the edges of the first and second antenna patches;

a second feeding line connected to the second antenna patch, wherein when the second feeding line feeds the second antenna patch, a second, sinusoidally varying E-field is generated in a second slot between the edges of the second and third antenna patches; and a third feeding line connected to the second antenna patch, wherein when the third feeding line feeds the second antenna patch, a third, sinusoidally varying E-field is generated in the second slot between the edges of the second and third antenna patches, said third sinusoidally varying E-field being rotated 90 degrees with respect to the second sinusoidally varying E-field.

2. The antenna arrangement according to claim 1, wherein the first feeding line feeds the first antenna patch at a first feeding point located at the center of the first antenna patch.

3. The antenna arrangement according to claim 2, wherein the second feeding line feeds the second antenna patch at a second feeding point laterally offset by a distance d from the first feeding point so that the second feeding point is located near the edge of the second antenna patch.

4. The antenna arrangement according to claim 3, wherein the third feeding line feeds the second antenna patch at a third feeding point laterally offset by a distance d from the first feeding point, and angularly offset from the second feeding point so that the third feeding point is located near the edge of the second antenna patch and offset from the second feeding point by approximately 90 degrees.

5. The antenna arrangement according to claim 4, further comprising:

a fourth feeding line connected to the second antenna patch; and a fifth feeding line connected to the second antenna patch;

wherein the fourth feeding line feeds the second antenna patch at a fourth feeding point laterally offset by a distance d from the first feeding point, and angularly offset from the third feeding point so that the fourth feeding point is located near the edge of the second antenna patch and offset from the third feeding point by approximately 90 degrees;

wherein the fifth feeding line feeds the second antenna patch at a fifth feeding point laterally offset by a distance d from the first feeding point, and angularly offset from the fourth feeding point so that the fifth feeding point is located near the edge of the second antenna patch and offset from the fourth feeding point by approximately 90 degrees; and wherein when the second and fourth feeding lines feed the second antenna patch, the second, sinusoidally varying E-field is generated in the second slot between the edges of the second and third antenna patches, and when the third and fifth feeding lines feed the second antenna patch, the third, sinusoidally varying E-field is generated in the second slot between the edges of the second and third antenna patches, said third sinusoidally varying E-field being rotated 90 degrees with respect to the second sinusoidally varying E-field.

6. The antenna arrangement according to claim 5, wherein the second and fourth feeding lines are fed with respective signals having a mutual phase difference of essentially 180 degrees, and wherein the third and fifth feeding lines are fed with respective signals also having a mutual phase difference of essentially 180 degrees.

7. The antenna arrangement according to claim 1, wherein the feeding mechanism is adapted to feed the antenna patches through the three feeding lines at the same time.

8. The antenna arrangement according to claim 1, wherein the antenna patches are symmetrical in shape around the first feeding point.

9. The antenna arrangement according to claim 1, wherein the antenna patches have essentially the same shape.

10. The antenna arrangement according to claim 9, wherein the antenna patches are essentially circular.

* * * * *

UNITED STATES PATENT AND TRADEMARK OFFICE

CERTIFICATE OF CORRECTION

PATENT NO. : 7,468,699 B2
APPLICATION NO. : 11/722910
DATED : December 23, 2008
INVENTOR(S) : Manholm et al.

It is certified that error appears in the above-identified patent and that said Letters Patent is hereby corrected as shown below:

In Column 8, Line 24, in Claim 1, delete "patches:" and insert -- patches; --, therefor.

Signed and Sealed this

Twenty-seventh Day of October, 2009

David J. Kappos

David J. Kappos
*Director of the United States Patent and Trademark Office*